US006923680B2

(12) United States Patent
Dumont et al.

(10) Patent No.: US 6,923,680 B2
(45) Date of Patent: Aug. 2, 2005

(54) ELECTRICAL APPARATUS INTENDED FOR MOUNTING ON A SUBFRAME

(75) Inventors: Roger Dumont, Benfeld (FR); Olivier Robert, Heiligenstein (FR)

(73) Assignee: Socomec, S.A., Benfeld (FR)

( * ) Notice: Subject to any disclaimer, the term of this patent is extended or adjusted under 35 U.S.C. 154(b) by 0 days.

(21) Appl. No.: 10/678,850

(22) Filed: Oct. 3, 2003

(65) Prior Publication Data

US 2004/0067699 A1 Apr. 8, 2004

(30) Foreign Application Priority Data

Oct. 4, 2002 (FR) ..... 02 12307

(51) Int. Cl.[7] ..... H01R 9/05
(52) U.S. Cl. ..... 439/582; 439/716
(58) Field of Search ..... 439/113, 174, 439/326, 352, 582, 709, 716, 801, 892; 335/202

(56) References Cited

U.S. PATENT DOCUMENTS 3,165,372 A * 1/1965 Jacobs et al. ..... 439/709
4,148,546 A * 4/1979 Wilson et al. ..... 439/687
5,064,384 A * 11/1991 Weaver ..... 439/511
5,588,880 A * 12/1996 Wood ..... 439/709
5,902,156 A * 5/1999 Geebelen et al. ..... 439/714
6,027,379 A * 2/2000 Hohorst ..... 439/715

FOREIGN PATENT DOCUMENTS

| | | |
|---|---|---|
| DE | 1915181 U | 5/1965 |
| DE | 20017134 U | 2/2002 |
| FR | 2786360 | 5/2000 |

OTHER PUBLICATIONS

French Search Report dated Jul. 1, 2003.

* cited by examiner

*Primary Examiner*—Ross Gushi
*Assistant Examiner*—James R. Harvey
(74) *Attorney, Agent, or Firm*—Davis & Bujold, P.L.L.C.

(57) ABSTRACT

An electrical apparatus for mounting on a frame that allows lateral connection as well as rear connection. The electrical apparatus (10) has connecting tabs (70, 70') arranged for connection to the electrical terminals (80, 80') of electrical apparatus (10) in such a way that they are removable and can be oriented in a lateral or rear position. The electrical terminals (80, 80') have mounting zones (80*a*, 80'*a*) forming an angle α equal to 45° with a rear wall (40) of the casing (20), and the connecting tabs (70, 70') have connecting segments (70*b*, 70'*b*) forming an angle β equal to 135° with the mounting segments (70*a*, 70'*a*). The casing (20) of the electrical apparatus (10) also has lateral openings (60, 60') and rear openings (61, 61') for the passage of connecting tabs (70, 70') wherein the lateral (60, 60') and rear (61, 61') openings are closed by a cover (21).

9 Claims, 5 Drawing Sheets

ELECTRICAL APPARATUS INTENDED FOR MOUNTING ON A SUBFRAME

This application claims foreign priority under 35 U.S.C. §119 of French Patent Application FR 02/12307 filed Oct. 4, 2002.

FIELD OF THE INVENTION

The present invention relates to an electrical apparatus which is intended for mounting on a frame, this electrical apparatus having at least two electrical terminals housed in a casing.

BACKGROUND OF THE INVENTION

Such electrical apparatuses are generally used for single phase, three phase, or four phase low voltage electrical distribution, the current ranging from a few tens to several hundred A. These can be switches, fuse switches, changeover switches, circuit breakers or any other electrical apparatus.

In a known manner, these electrical apparatuses are mounted in electrical distribution cabinets on plates or wiring frames. They are usually connected to an electrical circuit by electrical terminals that pass through the side walls of the casing and extend laterally beyond the casing. In certain configurations, however, it is necessary to connect these electrical apparatuses from the rear. In this case, L-shaped connecting tabs, called rear connections, are used that are produced specifically and to size and are connected to the projecting parts called electrical terminals. In order to comply with safety standards and to avoid any contact when an operator is working in an electrical cabinet, this solution requires the use of a specific enclosure covering the accessible part of the electrical terminals and the connecting tabs. This enclosure can interfere with heat dissipation of these electrical apparatuses which then tend to overheat, resulting in accelerated aging. In addition to this major disadvantage, it is necessary to stock all types of connecting tabs needed for all connection configurations, and to deliver the electrical apparatus accompanied by the types of connecting tabs needed by the client, resulting in a large extra cost. Furthermore, this rear connection mode involves a large lateral space requirement which limits the volume available in the electrical cabinet. This solution is therefore unsatisfactory.

SUMMARY OF THE INVENTION

The present invention aims to remedy these problems by proposing an electrical apparatus in which each electrical terminal is arranged so that it can be connected laterally as well as towards the rear, which is simple to manufacture and use, is economical, requires little space, and is reliable, and which allows use in complete safety, limits the risks of temperature rise at the site of the electrical connection, and proportionally increases the lifetime of the electrical apparatus.

With this aim, the invention relates to an electrical apparatus of the type indicated in the preamble, characterized by the fact that for each electrical terminal there is at least one tab for connection to an electrical circuit, the connecting tab being arranged for mounting on the electrical terminal so as to extend, as desired, laterally or towards the rear of the casing as a function of the configuration of connection to the electrical circuit, and by the fact that the casing has at least one lateral opening and one rear opening, made respectively in its lateral and rear walls opposite each electrical terminal.

According to a preferred embodiment, the rear and lateral openings define a single opening.

The connecting tab preferably has at least one mounting segment and at least one connecting segment, the electrical terminal has at least one mounting zone, the mounting segment and the mounting zone being arranged so as to be connected by some removable assembling means.

The mounting zone of each electrical terminal advantageously defines, with the rear wall of said casing, an angle $\alpha$ that is roughly equal to 45°. In the same way, the mounting segment and the connecting segment of each connecting tab advantageously define between them an angle $\beta$ roughly equal to 135°.

In the preferred embodiment, the electrical apparatus has at least one removable cover arranged so as to cover a pair of rear and lateral openings, with it being possible for this cover to have a gripping component.

The cover and the casing advantageously have complementary nesting shapes provided with means of locking, for example, by snapping.

This cover is advantageously made up of two covering flaps forming an angle $\delta$ roughly equal to 90°, at least one of these covering flaps being provided with a hole arranged to receive a connecting tab.

BRIEF DESCRIPTION OF THE DRAWINGS

The present invention and its advantages will appear more clearly in the following description of an embodiment, with reference to the appended drawings given as a non-limiting example, in which.

DETAILED DESCRIPTION

Figure 1A:
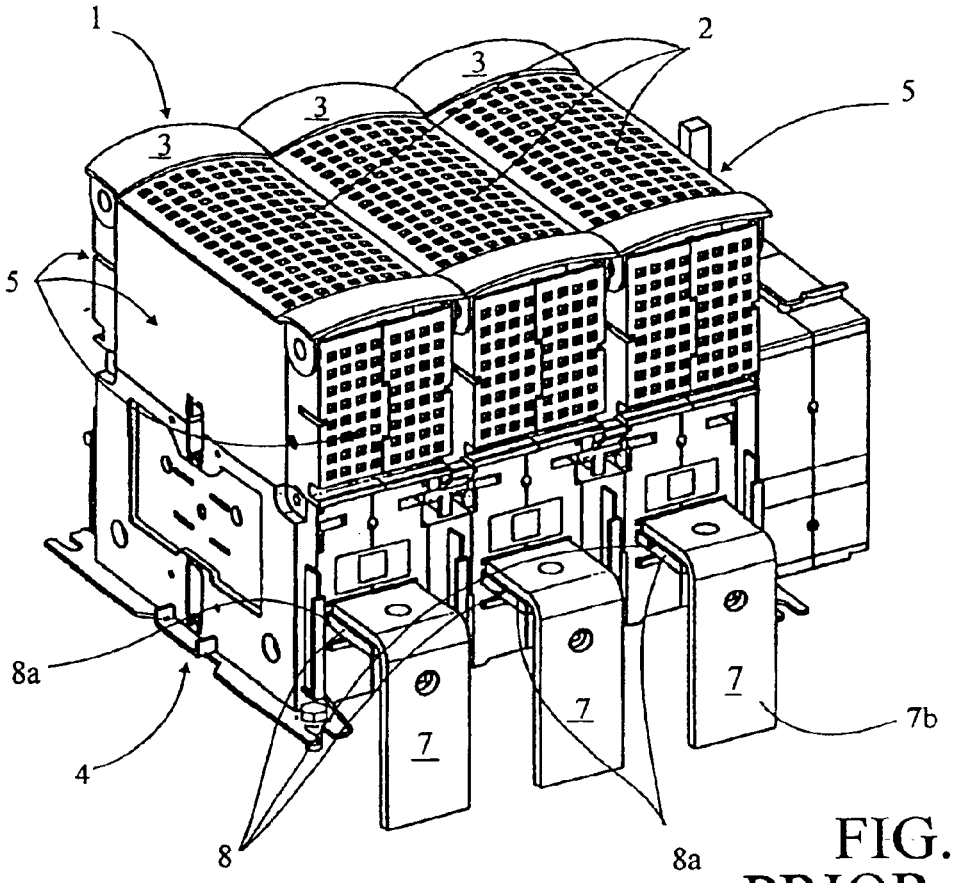
FIG. 1A PRIOR ART
FIGS. 1A and 1B are respectively an oblique view and a side view of the three phase electrical apparatus of the prior art, illustrating the two modes of connection: lateral and rear.
Figure 1B:
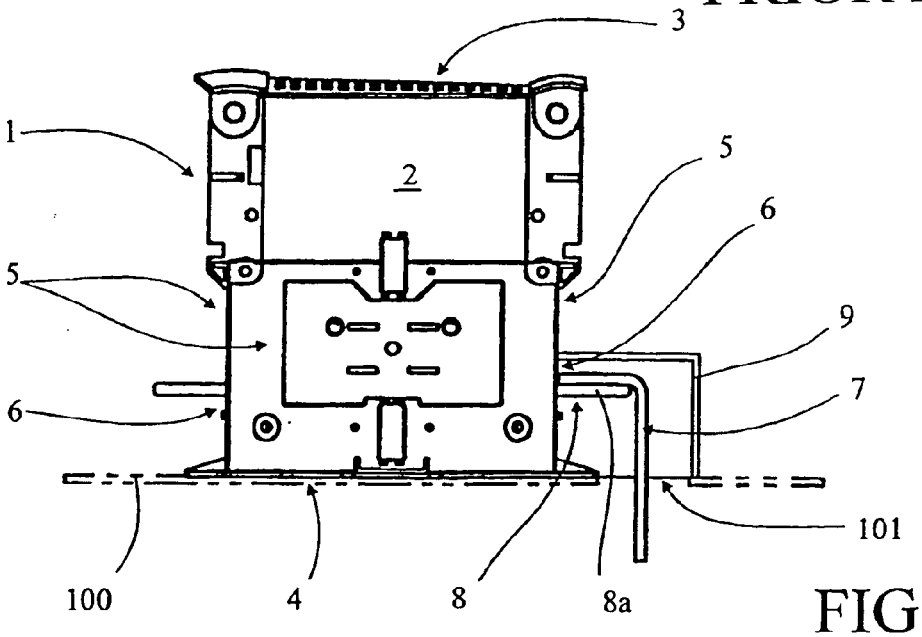
FIG. 1B PRIOR ART

With reference to FIGS. 1A and 1B, known electrical apparatuses 1 are traditionally intended for mounting on frame 100, for example, a plate arranged in an electrical cabinet. These electrical apparatuses 1 have casing 2, which is, for example, parallelipipedic or any other suitable shape. This casing defines front wall 3 and rear wall 4 connected by four lateral walls 5, rear wall 4 being used for laying and attaching electrical apparatus 1 on frame 100. Electrical apparatus 1 has electrical terminals 8 housed in casing 2 and extending laterally beyond the casing through holes 6 whose dimensions are suited to those of electrical terminals 8.

Electrical connection of this electrical apparatus 1 is made directly on projecting parts 8*a* of electrical terminals 8. This electrical connection is generally lateral (left side of FIGS. 1A, 1B). In order to execute a rear connection, one uses L-shaped connecting tabs 7 that are mounted on projecting parts 8*a* of electrical terminals 8 (right side of FIGS. 1A, 1B). In this case, frame 100 has passageways 101 for connecting tabs 7, making it possible, for example, to achieve connection to the electrical supply bars situated behind frame 100. In order to protect the operator working in the electrical cabinet from possible contact with a conducting part, connecting tab 7 is covered by removable cover 9, which is represented in FIG. 1B mounted between casing 2 and support 100. This cover 9 is, for example, formed by a front wall and three lateral walls and made of insulating material, and can have aeration openings, not represented, that limit the temperature rise.

Figure 2:
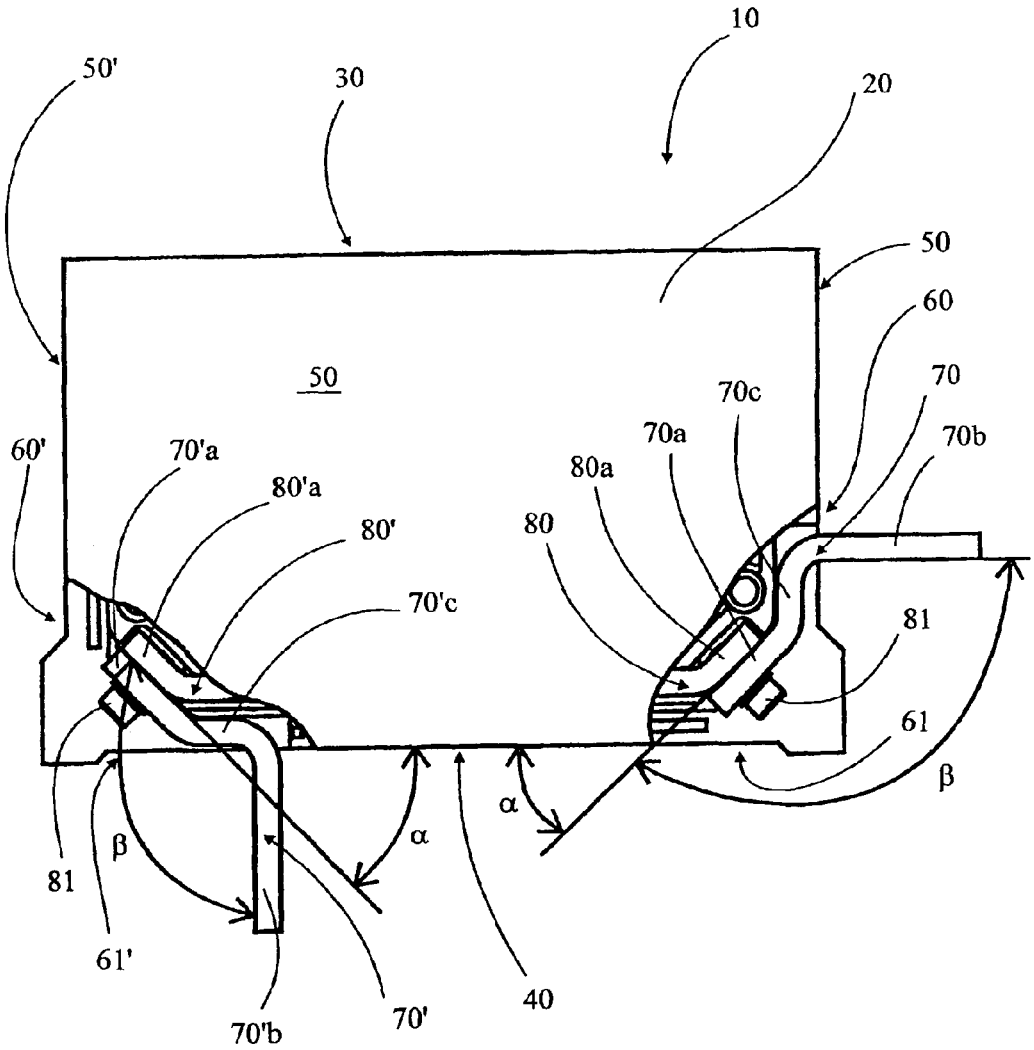
FIG. 2 is a side view of an electrical apparatus according to the invention, illustrating the two modes of connection: lateral and rear.

With reference to FIG. 2, the construction of electrical apparatus 10 according to the invention is essentially similar to that of electrical apparatus 1 of FIGS. 1A and 1B. This electrical apparatus 10 has at least two electrical terminals 80, 80' housed in casing 20 provided with front wall 30, rear wall 40 and lateral walls 50, 50'.

This electrical apparatus 10 is differentiated from the preceding one in particular by the fact that the electrical connection is no longer made directly on electrical terminals 80, 80' but rather via connecting tabs 70, 70' that are added on and are removable. Depending on their orientation, they allow one to connect electrical apparatus 10 laterally (right side of FIG. 2) or towards the rear (left side of FIG. 2). In order to attain this objective, electrical terminals 80, 80' have mounting zone 80*a*, 80'*a* which is capable of receiving said connecting tabs 70, 70', this mounting zone 80*a*, 80'*a* forming, with rear wall 40 of casing 20, an angle $\alpha$ roughly equal to 45°. Connecting tabs 70, 70' have mounting segment 70*a*, 70'*a* and connecting segment 70*b*, 70'*b* that [respectively] form between them an angle $\beta$ roughly equal to 135°. Opposite each electrical terminal 80, 80', casing 20 has lateral opening 60, 60' and rear opening 61, 61' that allow connecting tabs 70, 70' to pass through.

Figure 3A:
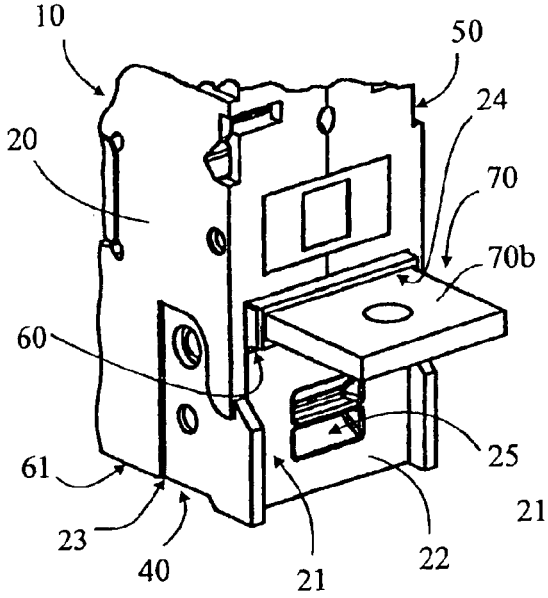
FIGS. 3A to 3D are partial oblique views of the electrical apparatus of FIG. 2, showing a connecting tab mounted in lateral position, and then the three steps of removing this connecting tab.
Figure 3B:
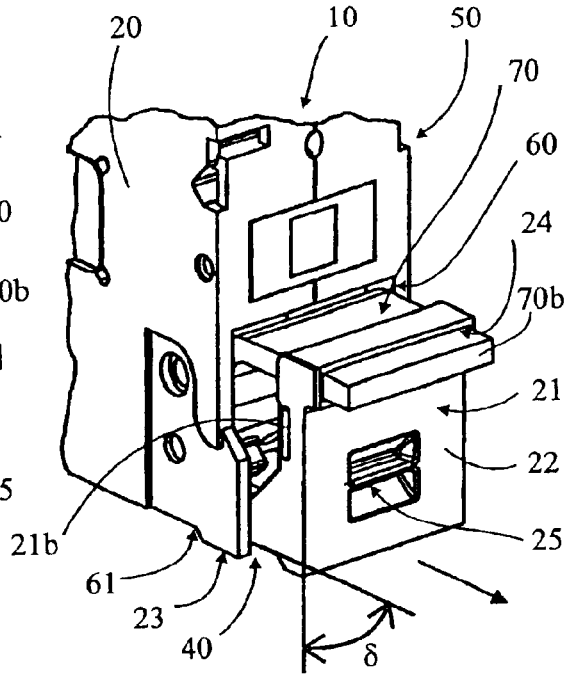
Figure 3C:
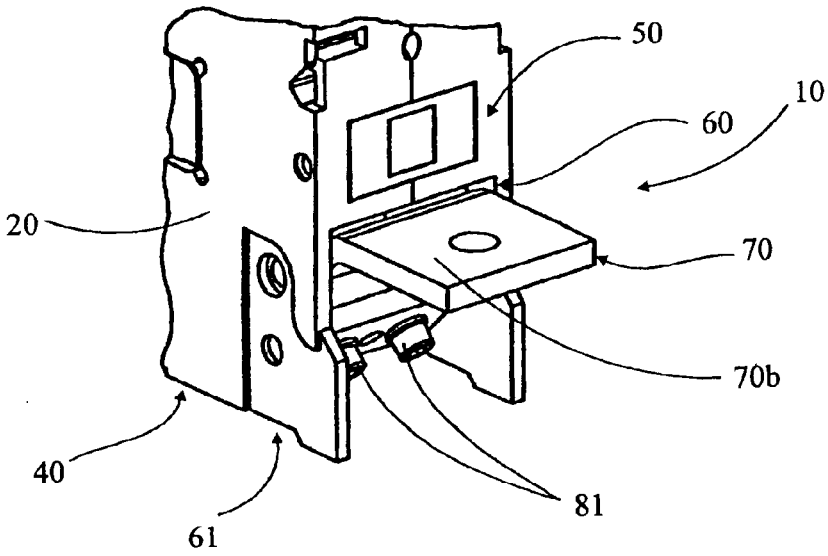
Figure 3D:
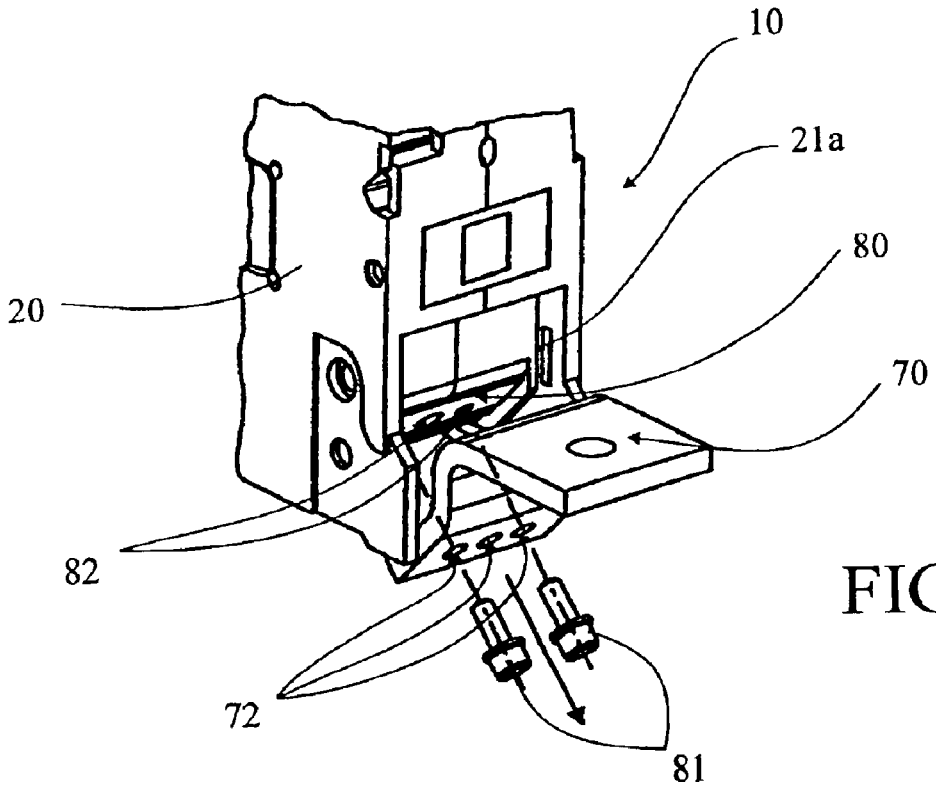

Mounting segments 70*a*, 70'*a* of connecting tabs 70, 70' and mounting zones 80*a*, 80'*a* of electrical terminals 80, 80' are provided with openings 72, 82, represented in FIG. 3D, said openings 72, 82 receiving fastening screw 81 enabling connection of each connecting tab 70, 70' to a corresponding electrical terminal 80, 80'. Connecting tabs 70, 70' can be attached on electrical terminals 80, 80' by any other equivalent assembling means.

In this example, connecting tabs 70, 70' have intermediate segment 70*c*, 70'*c* arranged between mounting segment 70*a*, 70'*a* and connecting segment 70*b*, 70'*b*. This intermediate segment 70*c*, 70'*c* defines with mounting segment 70*a*, 70'*a* an angle roughly equal to 45°, and with connecting segment 70*b*, 70'*b* an angle roughly equal to 90°. This intermediate segment can, among other things, facilitate positioning of connecting tab 70, 70' on electrical terminal 80, 80' during mounting. It also makes it possible to limit the space requirement of connecting tab 70, 70' outside of casing 20 while guaranteeing a fixed distance between two connecting tabs 70, 70' mounted in rear position.

Electrical apparatus 10 also has, for each electrical terminal 80, 80', removable L-shaped cover 21 that is capable of covering lateral 60, 60' and rear 61, 61' openings of casing 20. It has two covering flaps 22, 23 forming an angle $\delta$ roughly equal to 90°, which is represented in FIG. 3B. Cover 21 and casing 20 have complementary nesting shapes, for example, grooves 21*a* represented in FIGS. 3D, 4A and 4B and ribs 21*b* represented in FIGS. 3B and 4C. These complementary nesting shapes also make it possible to lock cover 21 to casing 20, by snapping, for example. One of covering flaps 22 has hole 24 arranged to receive connecting segment 70*b* of connecting tab 70. In this example, cover 21 has gripping component 25, for example, two indentations that can be grasped by a tool such as pliers or by two fingers of a hand.

According to an execution variant that is not shown, when electrical apparatus 10 has several poles, cover 21 allows one to increase the isolation distances between electrical terminals 80, 80' adjacent to the two poles.

FIGS. 3A to 3D illustrates the steps removing connecting tab 70 of apparatus 10 of FIG. 2 mounted beforehand in a lateral position (cf. FIG. 3A).

In order to modify the orientation of connecting tab 70, a first step consists of withdrawing cover 21 and translating it laterally (cf. FIG. 3B). Mounting screws 81 are then accessible (cf. FIG. 3C) and can be unscrewed. Once mounting screws 81 are withdrawn (cf. FIG. 3D), connecting tab 70 is removed.

Figure 4A:
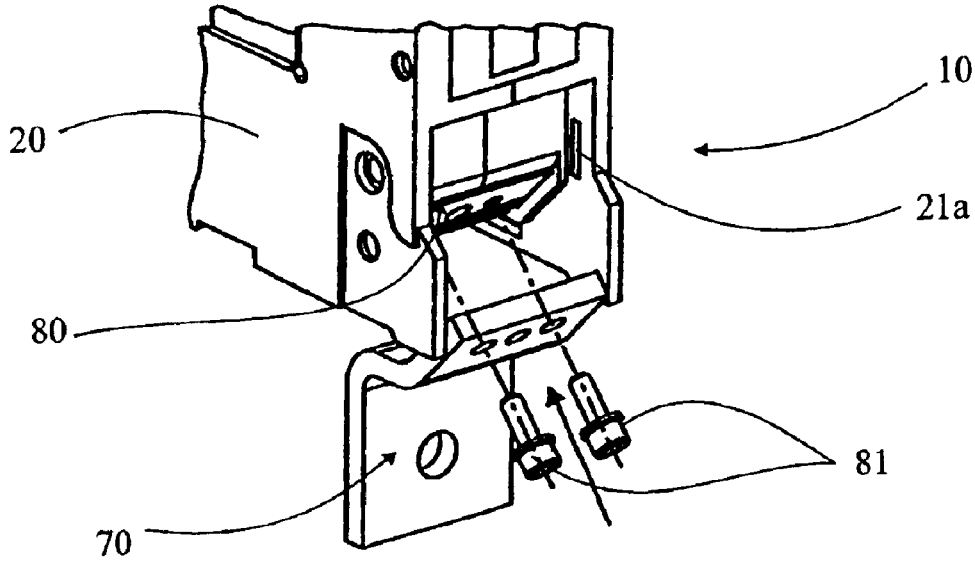
FIGS. 4A to 4D are partial oblique views of the electrical apparatus of FIGS. 3A to 3D, showing the three steps of mounting the connecting tab in rear position, and then the connecting tab mounted.
Figure 4B:
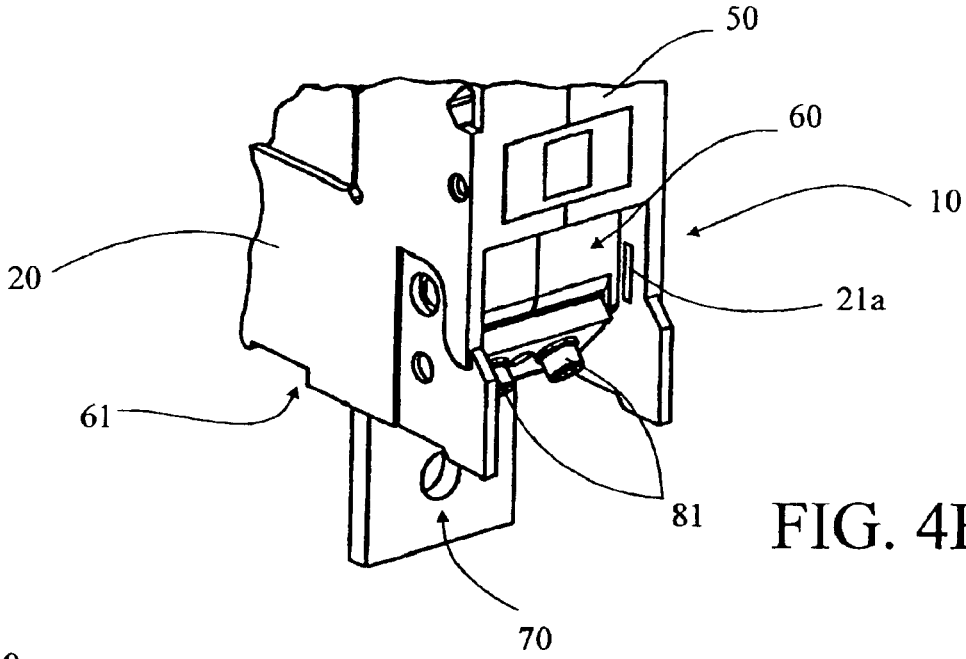
Figure 4C:
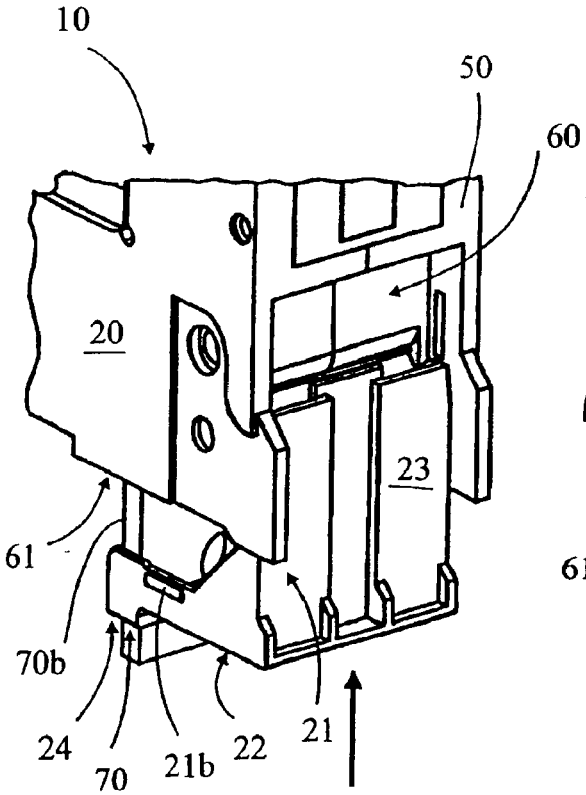
Figure 4D:
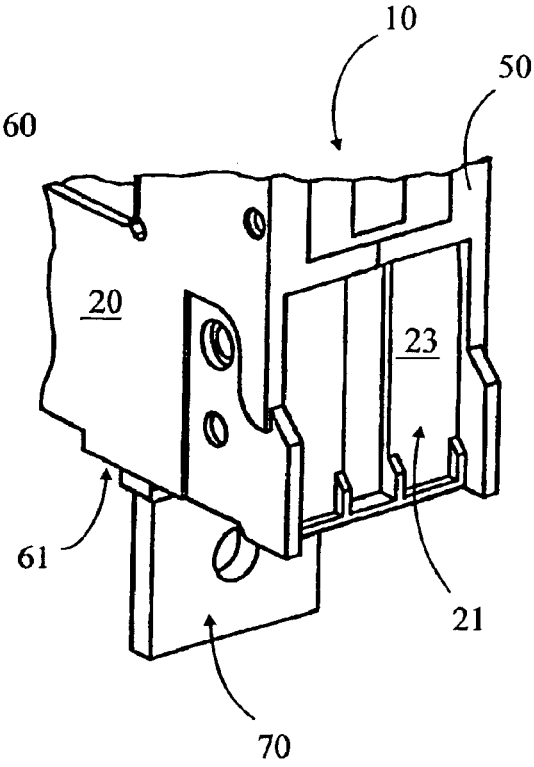

This connecting tab 70 can be turned over and mounted on the same electrical terminal 80 in rear position (cf. FIG. 4A). Mounting screws 81 are screwed in to attach connecting tab 70 to electrical terminal 80 in rear position (cf. FIG. 4B). Cover 21 is turned over (cf. FIG. 4C) and then inserted in casing 20 by translation from the rear to the front, taking care to introduce connecting segment 70*b* of connecting tab 70 into hole 24 of cover 21. Covering flap 22 covers rear opening 61, and covering flap 23 covers lateral opening 60 (cf. FIG. 4D.

This description shows clearly that the invention makes it possible to meet the aims that were set, in particular that this simple and economical electrical apparatus 10 can be quickly configured for lateral connection and for rear connection. Thanks to the design of this electrical apparatus 10, connecting tabs 70, 70' can ultimately be realized by the final client who thus can optimize their shape and their length as a function of his specific electrical connection, and thus economize in terms of a screwing point.

The present invention is not limited to the embodiment that has been described, but rather extends to any modification and variant obvious to an expert in the field while remaining within the scope of the protection defined in the appended claims.

What is claimed is:

1. An electrical apparatus (10) that is intended for mounting on a frame (100), the electrical apparatus (10) comprising:

at least two electrical terminals (80, 80') housed in a casing (20)

each of the electrical terminals (80, 80') having at least one connecting tab (70, 70') for connection to an electrical circuit, each connecting tab (70, 70') being mountable on the corresponding electrical terminal (80, 80') to extend one of laterally from the casing and towards the rear of the casing (20), and wherein the casing (20) has at least one lateral opening (60, 60') and at least one rear opening (61, 61'), in a lateral wall (50) and a rear (40) wall of the casing, and facing each electrical terminal (80, 80') to form a passage for the connecting tabs (70, 70').

2. An electrical apparatus (10) according to claim 1, wherein the rear (61, 61') opening and the lateral (60, 60') opening define a single opening.

3. An electrical apparatus (10) according to claim 1, wherein each of the connecting tabs (70, 70') has at least one mounting segment (70*a*, 70'*a*) and at least one connecting segment (70*b*, 70'*b*), each electrical terminal (80, 80') has at least one mounting zone (80*a*, 80'*a*), and the corresponding mounting segment (70*a*, 70'*a*) and mounting zone (80*a*, 80'*a*) are connected by a removable assembling means (81).

4. An electrical apparatus (10) according to claim 3, wherein the at least one mounting zone (80*a*, 80'*a*) of each of the electrical terminals (80, 80') defines an angle α with the rear wall (40) that is substantially equal to 45°, and the mounting segment (70*a*, 70'*a*) defines an angle β substantially equal to 135° with the connecting segment (70*b*, 70'*b*) of each of the connecting tabs (70, 70').

5. An electrical apparatus (10) according to claim 1, wherein the electrical apparatus has at least one removable cover (21) arranged to cover a rear (61, 61') opening and a lateral (60, 60') opening.

6. An electrical apparatus (10) according to claim 5, wherein the cover (21) and the casing (20) have complementary nesting shapes.

7. An electrical apparatus (10) according to claim 6, wherein the complementary nesting shapes are provided with a means of locking (21*a*, 21*b*) by snapping of the cover (21) on the casing (20) when the cover and the casing are nesting one with the other.

8. An electrical apparatus (10) according to claim 7, wherein the cover (21) includes two covering flaps (22, 23) forming an angle δ substantially equal to 90°, at least one of the covering flaps (22, 23) being provided with a hole (24) arranged to receive a connecting tab (70, 70').

9. An electrical apparatus (10) according to claim 5, wherein the cover (21) includes at least one gripping component (25).

* * * * *